US006405631B1

(12) United States Patent
Milek

(10) Patent No.: US 6,405,631 B1
(45) Date of Patent: Jun. 18, 2002

(54) SEMI-AUTOMATIC HANDGUN

(76) Inventor: Robert C. Milek, 15714 Patrick Ave., Omaha, NE (US) 68116

( * ) Notice: Subject to any disclaimer, the term of this patent is extended or adjusted under 35 U.S.C. 154(b) by 0 days.

(21) Appl. No.: 09/771,246

(22) Filed: Jan. 26, 2001

(51) Int. Cl.[7] ..... F41A 9/00

(52) U.S. Cl. ..... 89/139; 42/70.02; 42/76.01; 42/10; 42/11; 89/161; 89/145

(58) Field of Search ..... 89/139, 160, 161; 42/10, 11

(56) References Cited

U.S. PATENT DOCUMENTS

| | | | | | |
|---|---|---|---|---|---|
| 984,519 | A | | 2/1911 | Browning | 42/7 |
| 4,155,187 | A | * | 5/1979 | Lichtman | 42/11 |
| 4,575,963 | A | | 3/1986 | Ruger et al. | 42/70 |
| 5,123,329 | A | * | 6/1992 | Irwin | 89/161 |

* cited by examiner

*Primary Examiner*—Michael J. Carone
*Assistant Examiner*—Denise J Buckley
(74) *Attorney, Agent, or Firm*—Thomte, Mazour & Niebergall; Dennis L. Thomte

(57) ABSTRACT

A semi-automatic handgun is disclosed including a frame having a barrel housing mounted thereon. A barrel is movably mounted on the barrel housing and has a cartridge chamber at its rearward end for receiving a cartridge therein. The barrel is movable between a rearward position and a forward position with respect to the barrel housing and is normally in its rearward position. The barrel moves forwardly in a straight line from its rearward position upon firing of the cartridge in the chamber to counteract the rearward energy of discharge, thereby reducing recoil. The handgun may be fired in either a single action or double action manner. The firing hammer of the handgun is re-cocked, upon firing of the cartridge, by means of a movable piston having a firing pin positioned therein with the firing pin engaging the hammer to move the hammer to its re-cocked position.

14 Claims, 11 Drawing Sheets

SEMI-AUTOMATIC HANDGUN

BACKGROUND OF THE INVENTION

1. Field of the Invention

This invention relates to a semi-automatic handgun and more particularly to a semi-automatic handgun wherein the barrel thereof moves forwardly with respect to the frame of the handgun when the cartridge in the barrel is fired.

2. Description of the Related Art

The mechanical action of high-powered semi-automatic handguns has changed very little since an invention by John Browning at the turn of the twentieth century. In semi-automatic pistols, such as the Colt 1911 A1 pistol invented by Browning, the recoil action created by the energy of firing a cartridge causes the barrel, which is located in a sliding housing, to move rearwardly and most often tilted downwardly to eject the spent cartridge and to deliver a new round from the cartridge clip or magazine. To prevent excessive blowback at the breech, the barrel and slide are locked together for a short distance to allow the chamber pressure to drop to a safe level before the breech is opened. The higher energy produced by more powerful ammunition results in high velocity of the slide which must be retarded by a strong recoil spring. The strong spring force of the recoil spring requires greater effort in manually retracting the slide to re-cock the hammer and recharge the chamber. As more powerful ammunition has been developed, such as the 10 mm. cartridge, the problem has increased requiring still stronger recoil springs along with more uncomfortable recoil on firing. Further, the fact that the barrel of semi-automatic handguns, such as the 1911 A1 pistol, must be pivoted downwardly necessitates some play between the barrel and the slide through the use of a bushing. The fact that some tolerance must be provided between the barrel and the bushing and due to the fact that wear occurs on the bushing creates accuracy problems. Additionally, since the barrels of semi-automatic handguns such as the 1911 A1 have relatively short lengths, the accuracy thereof is sometimes less than desirable.

SUMMARY OF THE INVENTION

A semi-automatic weapon such as a handgun is disclosed which includes a frame including a grip, a trigger guard, a trigger, and a cartridge magazine removably mounted in the grip. The cartridge magazine is adapted to have cartridges contained therein in a vertically stacked manner. A barrel housing is mounted on the upper end of the frame and has a breech formed therein which has rearward and forward ends. The breech is in communication with the cartridge magazine to enable the cartridge magazine to successively feed cartridges to the breech. The barrel housing has a first elongated opening formed therein which extends forwardly from the forward end of the breech to the forward end of the barrel housing. The barrel housing has a second elongated opening formed therein which extends rearwardly from the rearward end of the breech towards the rearward end of the barrel housing. An elongated barrel, having forward and rearward ends, is movably mounted in the barrel housing between a rearward battery position in the barrel housing to a forward position therein. The barrel has a bore extending therethrough which defines a chamber at the rearward end thereof. A barrel spring is positioned in the barrel housing for yieldably urging the barrel towards its rearward battery position. The barrel closes the breech when the barrel is in its rearward battery position.

A piston is movably mounted in the second elongated opening formed in the barrel housing and is normally urged forwardly by a spring associated therewith. A spring-loaded firing pin is movably positioned in the piston with the forward end thereof protruding beyond the breech face or forward end of the piston with the rearward end thereof protruding rearwardly from the rearward end of the piston. A hammer is pivotally mounted on the frame which is movable between a rearward cocked position and a forward firing or de-cocked position. The trigger is operatively connected to the hammer by means of a sear assembly. A hammer or main spring is positioned in the frame and is connected to the hammer for driving the hammer from its rearward cocked position to its forward firing position when the trigger is depressed. When the hammer is driven forwardly, the hammer strikes the firing pin with the forward end of the firing pin striking the primer of the cartridge located in the chamber of the barrel to detonate the same. The detonation of the cartridge causes the barrel to move from its rearward position to its forward position against the resiliency of the barrel spring. The forward movement of the barrel within the barrel housing reduces the recoil imparted to the frame. The forward movement of the barrel during firing improves the accuracy of the handgun. The cocking of the hammer is achieved by rearward movement of the piston upon firing which imparts energy to the firing pin and in turn to the hammer.

The construction of the cartridge magazine is also believed to be unique in that a flexible cartridge retainer means is provided on the upper end thereof which enables the cartridges to be loaded into the magazine in a straight downwardly fashion. The magazine cartridge feeds the cartridges upwardly in a horizontally disposed position so as to be aligned with the chamber and bore of the barrel. The rearward end of the chamber of the barrel is positioned near the rear of the cartridge magazine which results in an effective longer barrel without increasing the overall length of the weapon which also results in increased energy and velocity.

It is therefore a principal object of the invention to provide an improved semi-automatic handgun.

A further object of the invention is to provide a semi-automatic handgun having a barrel slidably mounted in a barrel housing with the barrel moving forwardly when the handgun is fired.

Yet another object of the invention is to provide a semi-automatic weapon which decreases the amount of recoil imparted to the frame thereof.

Still another object of the invention is to provide a semi-automatic handgun which is constructed so that less force is required to manually open the breech.

Still another object of the invention is to provide a semi-automatic handgun wherein a barrel is slidably mounted in a barrel housing with the barrel moving in a straight line with respect thereto.

Still another object of the invention is to provide a semi-automatic weapon wherein the hammer is re-cocked by means of a movable piston positioned between the rear end of the cartridge in the chamber and the hammer.

Still another object of the invention is to provide a semi-automatic handgun wherein the forward movement of the barrel on firing assists in counteracting the rearward energy of discharge, thus reducing recoil.

Still another object of the invention is to provide a handgun of the type described wherein the barrel travels forwardly in a straight line to accomplish ejection of the spent cartridge and recharging of the chamber.

Still another object of the invention is to provide a semi-automatic handgun wherein the chamber end of the barrel is positioned to the rear of the cartridge magazine, when the barrel is in the battery position, resulting in a longer barrel without increasing the overall length of the weapon, resulting in increased energy and velocity.

Still another object of the invention is to provide a semi-automatic handgun wherein the cartridges are elevated from a cartridge magazine horizontally and directly in line with the bore thereby eliminating ramp charging to reduce the chances of jamming.

Still another object of the invention is to provide a semi-automatic handgun including a cartridge magazine which may be loaded straight downwardly.

Still another object of the invention is to provide a semi-automatic handgun which is economical of manufacture, durable in use and refined in appearance.

These and other objects will be apparent to those skilled in the art.

DESCRIPTION OF THE PREFERRED EMBODIMENT

Figure 1:
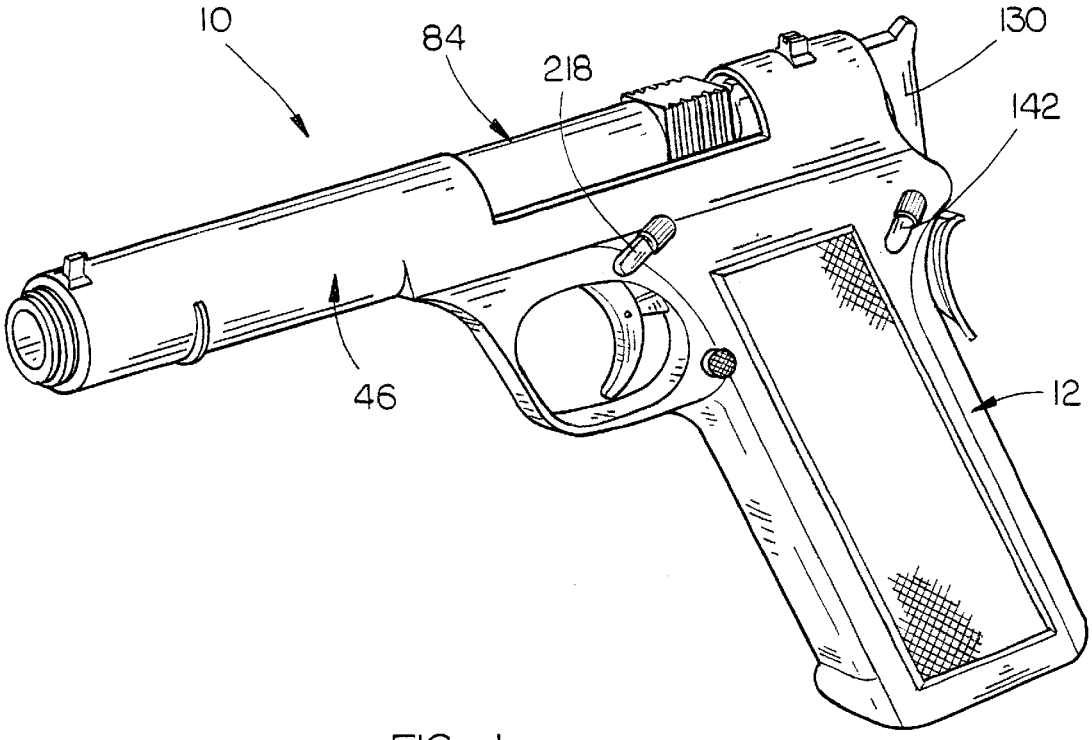
FIG. 1 is a front perspective view of the handgun of this invention.
Figure 2:
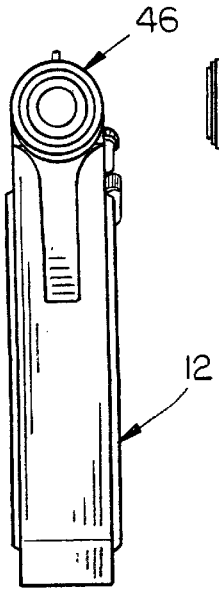
FIG. 2 is a front view of the handgun.
Figure 3:
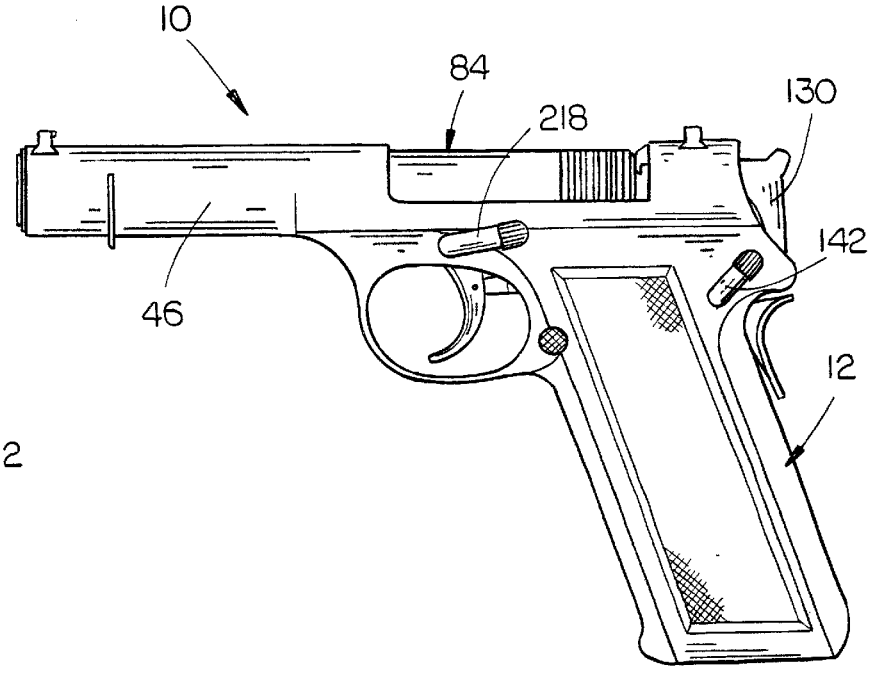
FIG. 3 is a side view of the handgun.

The semi-automatic handgun of this invention is referred to generally by the reference numeral 10. Although the weapon disclosed herein is ideally suited for use as a handgun, it is possible that certain of the mechanisms thereof could also be used in weapons other than handguns. Handgun 10 generally includes a frame 12 including a grip 14, trigger guard 16, magazine release button 18, and an opening 20 extending upwardly into the lower end of the grip 14 designed to receive a cartridge magazine or clip 22.

Figure 14:
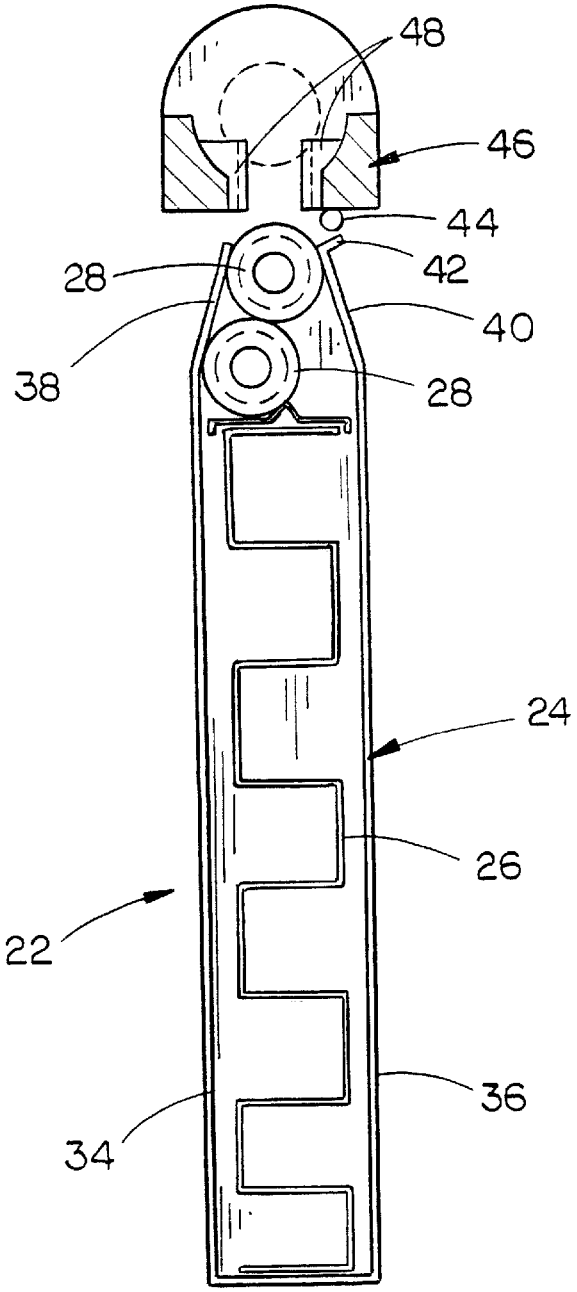
FIG. 14 is a rear sectional view of the cartridge magazine and its relationship to the frame as the magazine is being inserted into the handgun.

Magazine 22 includes a housing 24 having a follower spring 26 provided therein for urging the cartridges 28 upwardly in a substantially horizontally disposed condition so that they will be aligned with the bore of the barrel as will be described hereinafter. For purposes of description, magazine 22 will be described as including a forward end 30, rearward end 32, and opposite sides 34 and 36. The upper end of side 34 includes an inwardly and upwardly extending portion 38 while the upper end of side 36 includes an upwardly and inwardly extending portion 40. Lip 42 is provided on the upper end of upwardly and inwardly extending portion 40 and is designed to engage the lug 44 provided on the barrel housing as the magazine is inserted into the handgun. The portion 38 of the side 36 is preferably flexible and yieldably maintains the cartridges 28 within the magazine 22, as illustrated in FIG. 14. As the magazine 22 is moved to its completely inserted position, lip 42 engages lug 44 which causes portion 40 to deflect outwardly thereby permitting the cartridges 28 to pass from the upper end of the magazine into the guides 48. The flexible characteristic of the portion 40, which may be comprised of plastic or metal, enables the cartridges 28 to be inserted directly downwardly into the magazine when the magazine is being loaded. The relationship of portions 38 and 40 also permits the cartridges to pass directly vertically upwardly from the magazine in a horizontally disposed condition.

Figure 5:
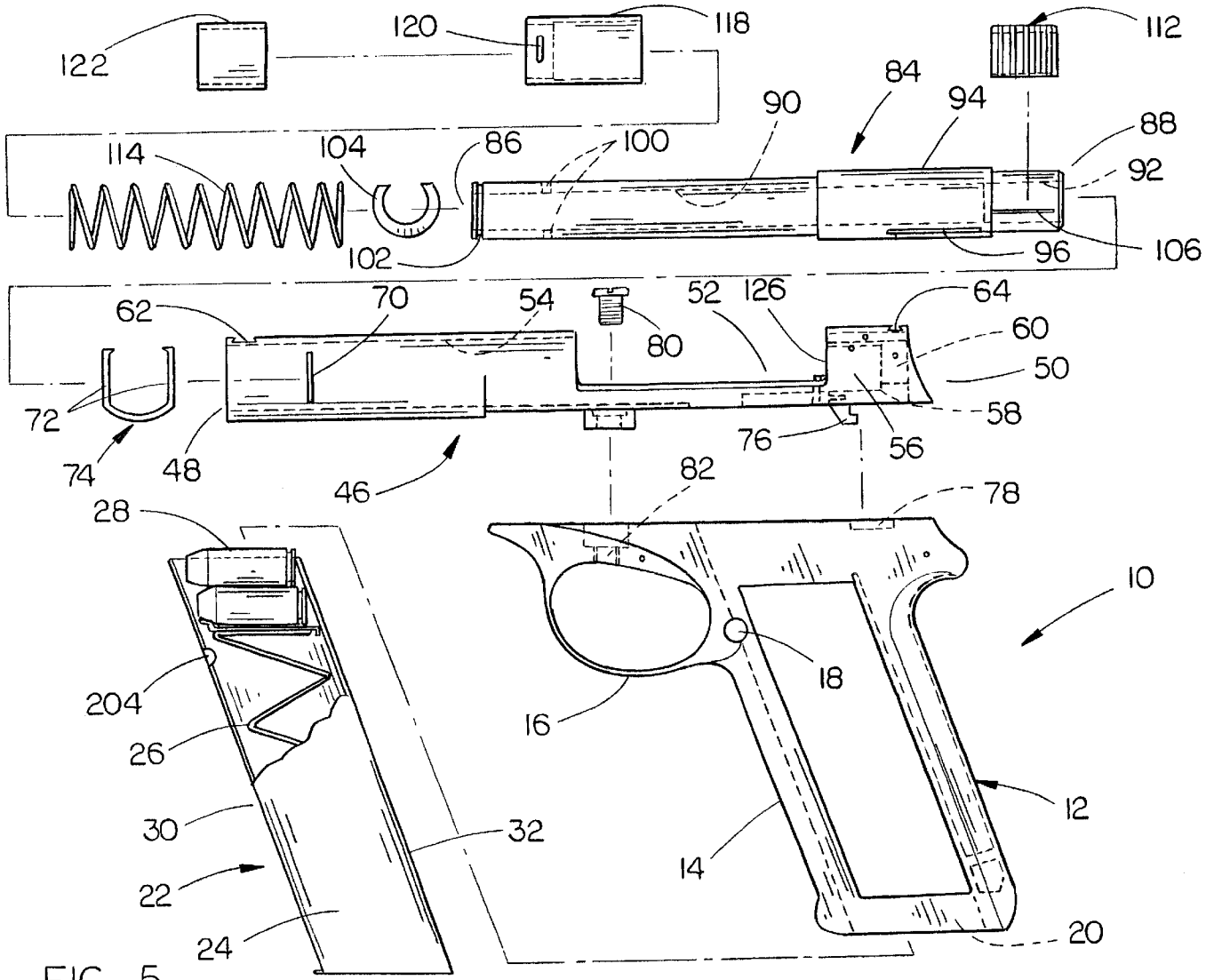
FIG. 5 is a partial exploded view of the handgun.

The barrel housing 46 includes a forward end 48 and a rearward end 50. The lower end of housing 46 is open and communicates with a breech 52 which also serves as an ejection port. Barrel housing 46 includes an elongated cylindrical opening 54 which extends forwardly from the forward end of the breech 52 to the forward end 48 of the housing 46. A cylindrical opening 56 is formed in barrel housing 46 and extends rearwardly from the rearward end of breech 52. The rearward end of the opening 56 defines a shoulder 58. Opening 60 is formed in barrel housing 46 rearwardly of opening 56. Barrel housing 46 is provided with dovetail grooves 62 and 64 formed therein adapted to receive sights 66 and 68 therein, respectively. Barrel housing 46 is provided with a pair of slots 70 on opposite sides thereof which extend through the side walls of the barrel housing 46 and which are adapted to receive the legs 72 of retaining clip 74. A hook or lug 76 extends downwardly from the rearward end of barrel housing 46 and is adapted to be received in a retaining slot 78, as illustrated in FIG. 5. Screw 80 extends downwardly through the barrel housing 46 and is threadably received in an internally threaded opening 82 to enable the barrel housing 46 to be selectively removably secured to the frame 12.

The numeral 84 refers to an elongated barrel having a forward end 86 and a rearward end 88. Barrel 84 is provided with a conventional rifled bore 90 formed therein which extends forwardly from a cartridge chamber 92 formed at the rearward end of the bore 90. Barrel 84 is provided with an enlarged diameter portion 94 forwardly of its rearward end, as best seen in FIG. 5. The barrel 84 has a drag link groove 96 formed therein and a trigger block groove 98 formed therein. Barrel 84 is provided with gas ports 100 formed therein adjacent the forward end thereof which extend inwardly therethrough for communication with the bore 90. The forward end of barrel 84 has an annular groove 102 formed therein which is adapted to receive retaining clip 104. The rearward end of barrel 84 has a pair of longitudinally extending grooves 106 formed therein on opposite sides thereof adapted to receive the lower ends 108 and 110 of barrel grip portion 112.

Barrel 84 is inserted into the forward end of opening 54 in barrel housing 46. Barrel spring 114 is slipped over the forward end of the barrel 84 so that its rearward end engages the shoulder 116 at the forward end of the enlarged diameter portion 94. Barrel stop 118 is then slipped over the forward end of the spring 114 and is held in position by means of the retaining clip or ring 74, the legs of which are inserted into the openings 70 so as to be received in the openings 120 formed on opposite sides of the forward end of the barrel stop 118. Muzzle sleeve 122 is then slipped over the forward end of the barrel 84 forwardly of the forward end of spring 114. The retaining clip 104 is then inserted into the annular groove 102 to maintain muzzle sleeve 122 in position.

Figure 4:
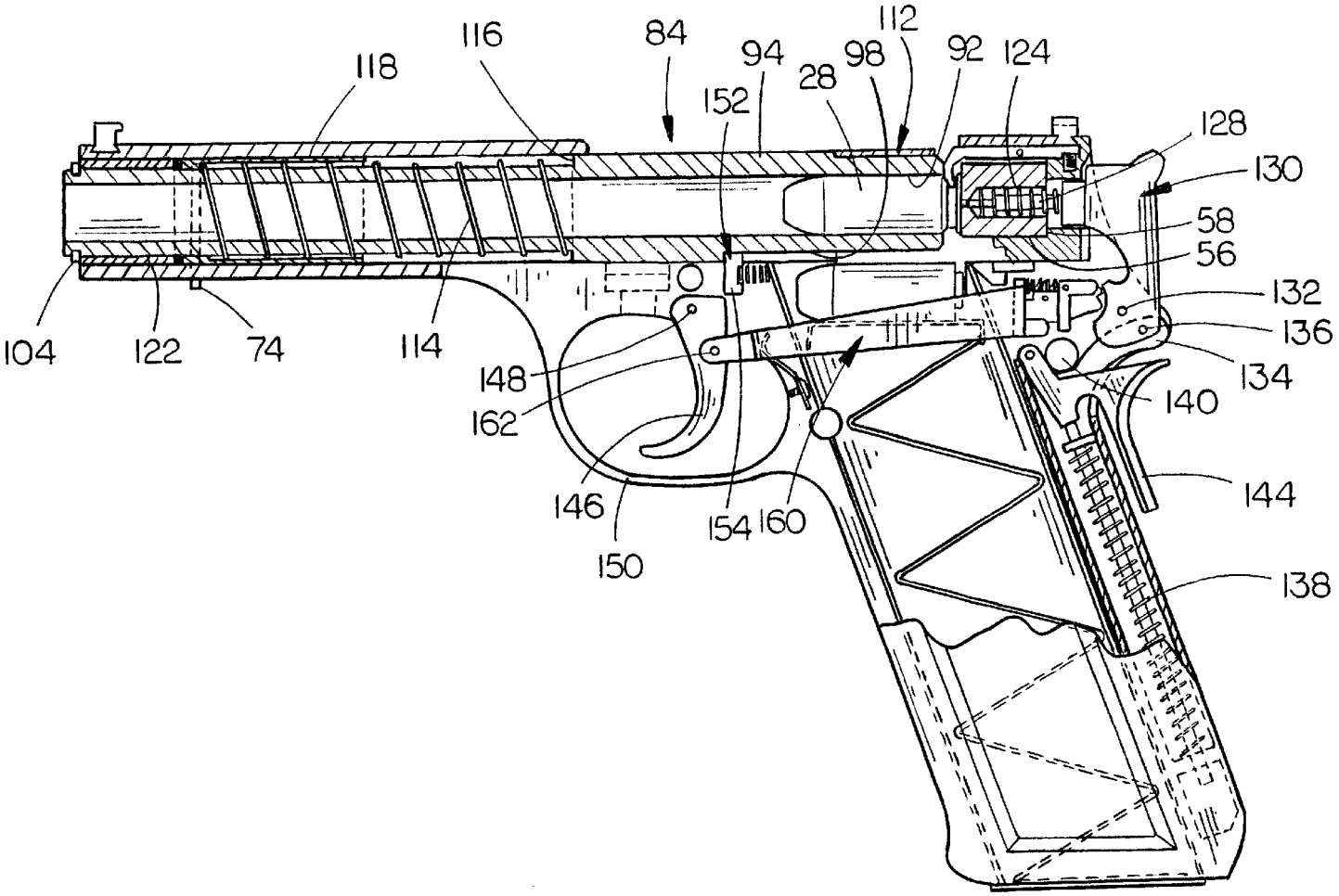
FIG. 4 is a partial vertical sectional view of the handgun.

The numeral 124 refers to a piston which is movably mounted in opening 56. A spring-loaded firing pin 128 is movably mounted within the piston 124 and is adapted to protrude forwardly from the forward end of piston 124 when the hammer 130 strikes the rearward end of the firing pin 128. Hammer 130 is pivotally mounted at the upper rearward end of the frame 12 at 132. The lower rearward end of hammer 130 is pivotally connected to the upper rearward end of hammer spring guide 134 at 136. Hammer or main spring 138 is mounted on the lower end of hammer spring guide 134 to urge or drive the hammer 130 from its rearward cocked position to its forward firing position. A rotating bolt 140 is selectively rotatably mounted in the frame 12 adjacent the hammer spring guide 134, as seen in FIG. 4, to selectively prevent the movement of the hammer spring guide 134 thereby preventing the hammer 130 from moving from its cocked position to its firing position. Bolt 140 is provided at the inner end of safety/de-cocker 142 which is positioned adjacent the upper rearward end of the exterior surface of the frame 12, as seen in FIG. 1. The numeral 144 refers to a generally conventional grip safety which prevents upward movement of the hammer spring guide 134 when it is in its "on" position of FIG. 4. When the grip safety 144 is depressed and the safety/de-cocker is in the "off" position, the hammer 130 will move from its fully de-cocked position to its firing position when the trigger is pulled.

Trigger 146 is pivotally connected at its upper end to the frame 12 at 148 and is enclosed within a trigger guard 150. Trigger 146 is prevented from moving rearwardly by means of a trigger safety 152. Trigger safety 152 includes a spring-loaded trigger block 154. As the barrel 84 moves to its fully closed or battery position, the front end of the trigger block groove 98 (FIG. 4) causes the trigger block 154 to retract against spring tension so that the trigger may be moved rearwardly.

Figure 6:
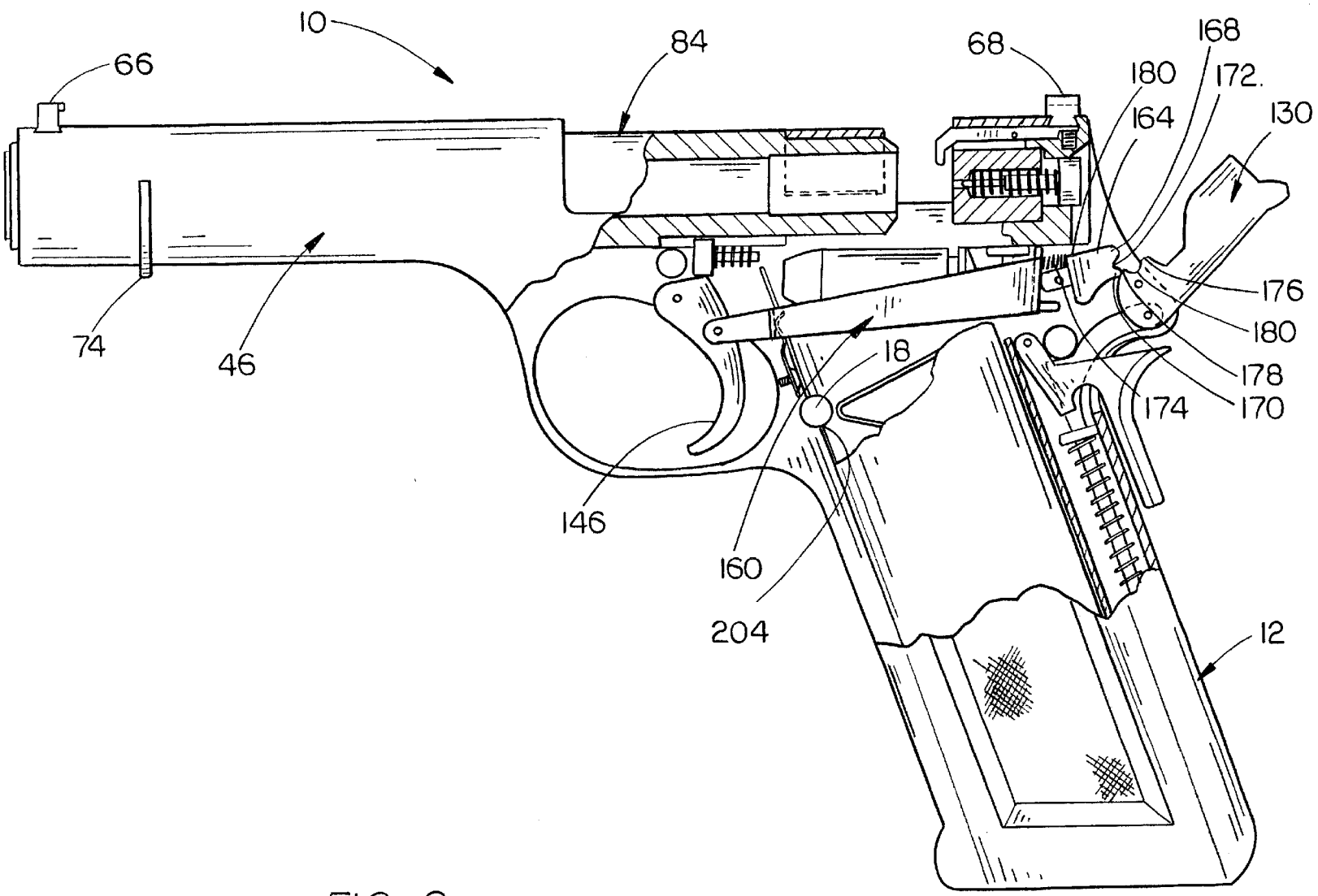
FIG. 6 is a partial sectional view of the handgun.
Figure 7:
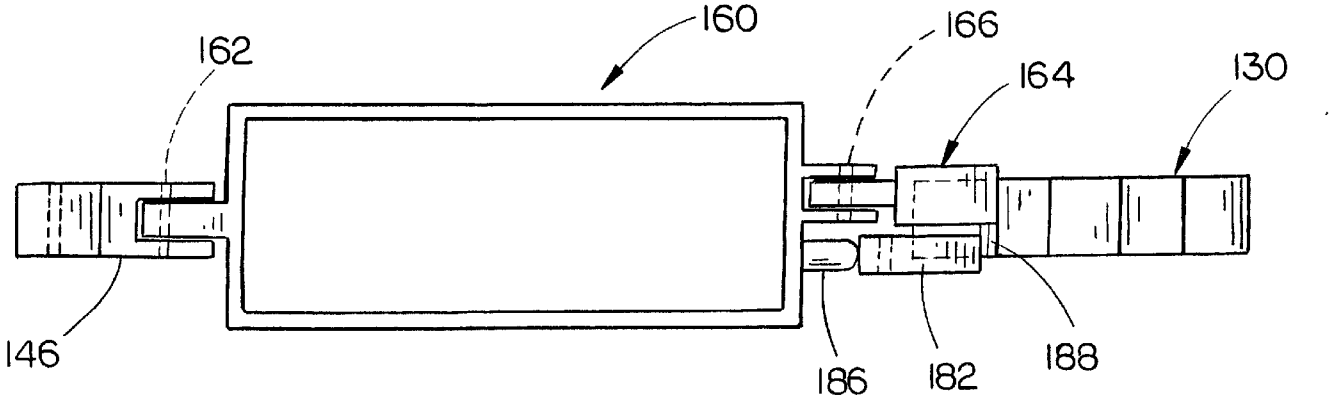
FIG. 7 is a top elevational view of the trigger, bow assembly, sear and hammer.
Figure 8:
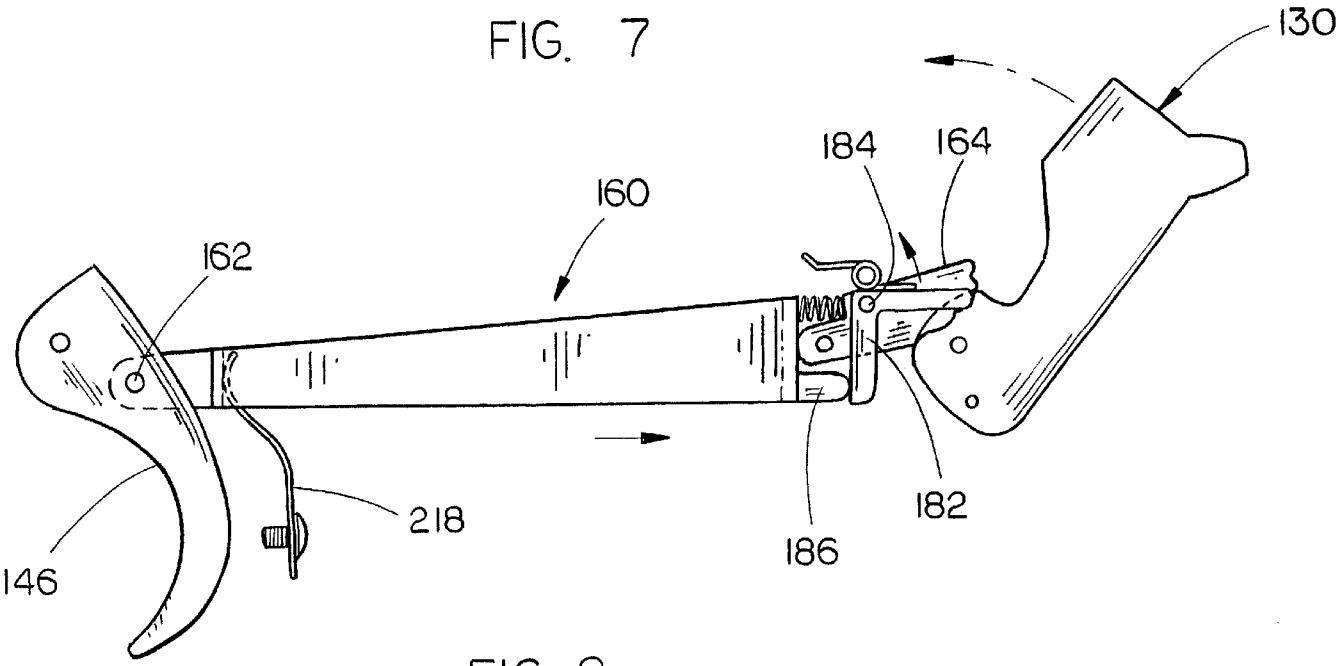
FIG. 8 is a side elevational view of the trigger, bow assembly, sear and hammer of FIG. 7.
Figure 9:
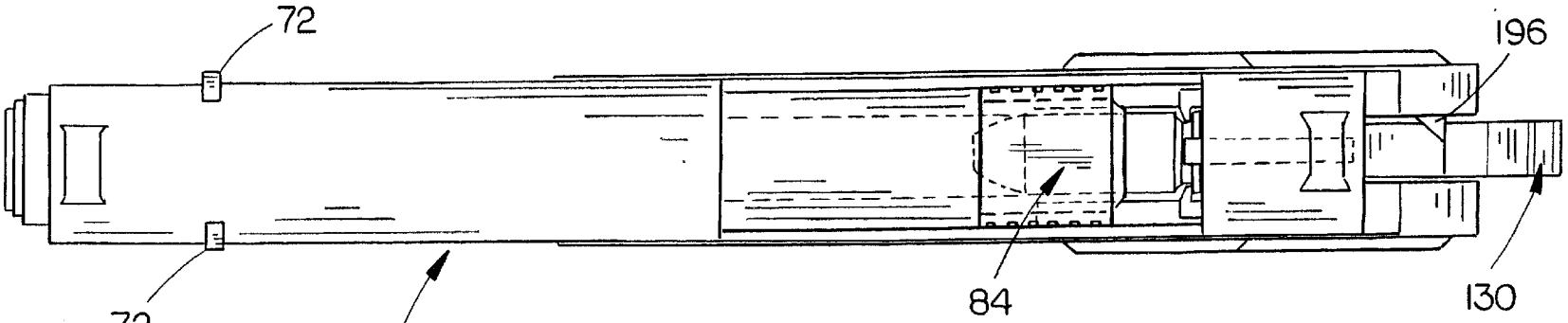
FIG. 9 is a top elevational view of the handgun.

The numeral 160 refers to a bow assembly which has its forward end pivotally connected to trigger 146 at 162. A cocking pawl 164 is pivotally connected to the rearward end of bow assembly 160 at 166. Cocking pawl 164 is provided with a pair of lugs 168 and 170 formed therein which define an arcuate groove 172 therebetween. As seen, spring 174 normally urges cocking pawl 164 in a clockwise direction, as viewed in FIG. 6. The lower forward end of hammer 130 is provided with a pair of cams 176 and 178 formed at one side thereof which define an arcuate groove 180 therebetween, as also seen in FIG. 6. A spring-loaded sear 182 is pivotally mounted in the frame 12 at 184. Bow assembly 160 includes a rearwardly extending bearing lug 186 which is adapted to engage the lower end of sear 182 to move the sear 182 out of engagement with the lower forward end of the hammer 130, as will be described in greater detail hereinafter. As seen in FIG. 7, the sear 182 is adapted to engage a shoulder 188 formed on the lower forward end of the hammer 130 laterally of the pawl 164 and laterally of the lugs 176 and 178.

Figure 10:
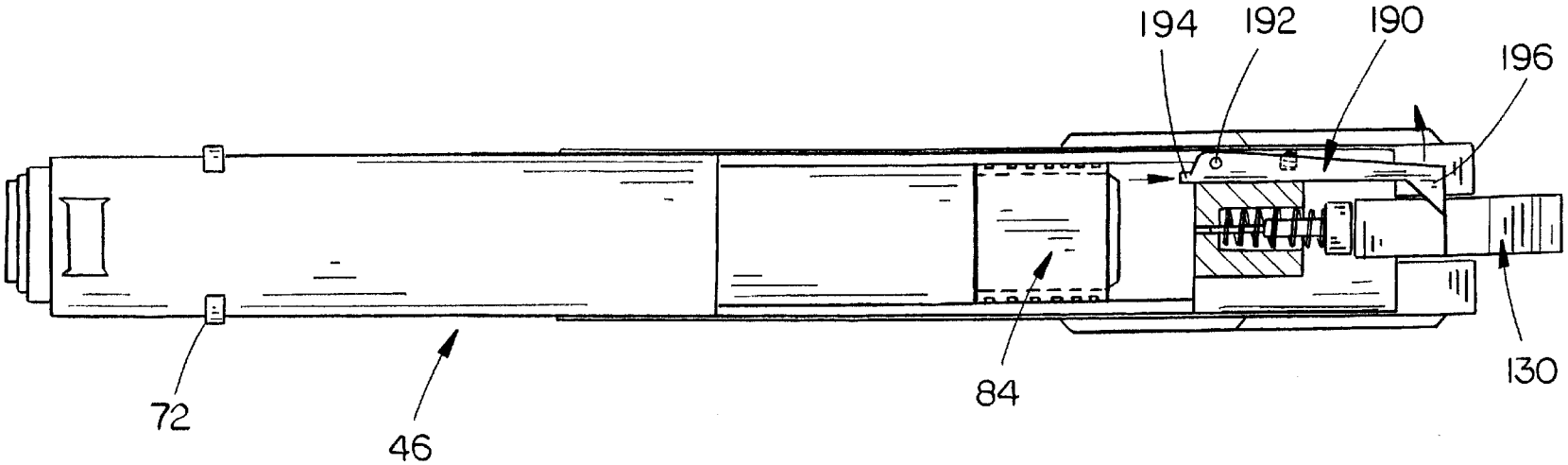
FIG. 10 is a top elevational view of the handgun illustrating the relationship of the barrel housing and hammer safety.

As seen in FIG. 10, the numeral 190 refers to a spring-loaded hammer safety which is pivoted to the frame 12 at 192. The forward end of safety 190 has a shoulder 194 protruding therefrom while the rearward end of the safety 190 has a laterally extending portion 196. Laterally extending portion 196 of safety 190 is positioned in the forward path of hammer 130 until the barrel 84 is in its completely closed position. As the barrel 84 moves rearwardly, the barrel 84 engages shoulder 194 to pivot safety 190 in a counterclockwise direction, as viewed in FIG. 10, so that the laterally extending portion 196 is moved laterally out of the forward path of the hammer 130.

Figure 11B:
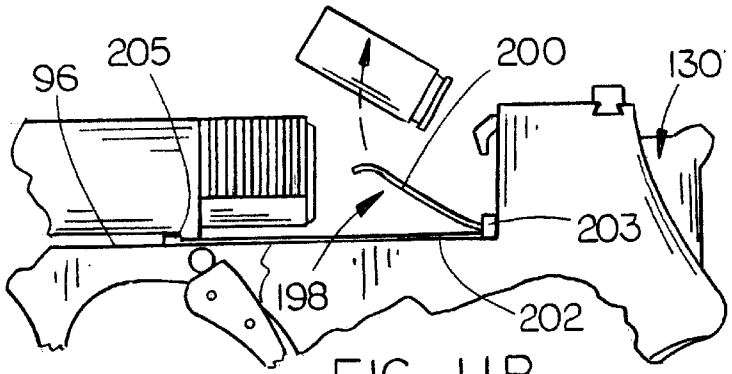
FIG. 11A is a sectional view illustrating the handgun with the barrel in its fully forward position.
FIG. 11 B is a partial side view of the handgun illustrating the ejection system.
Figure 11A:
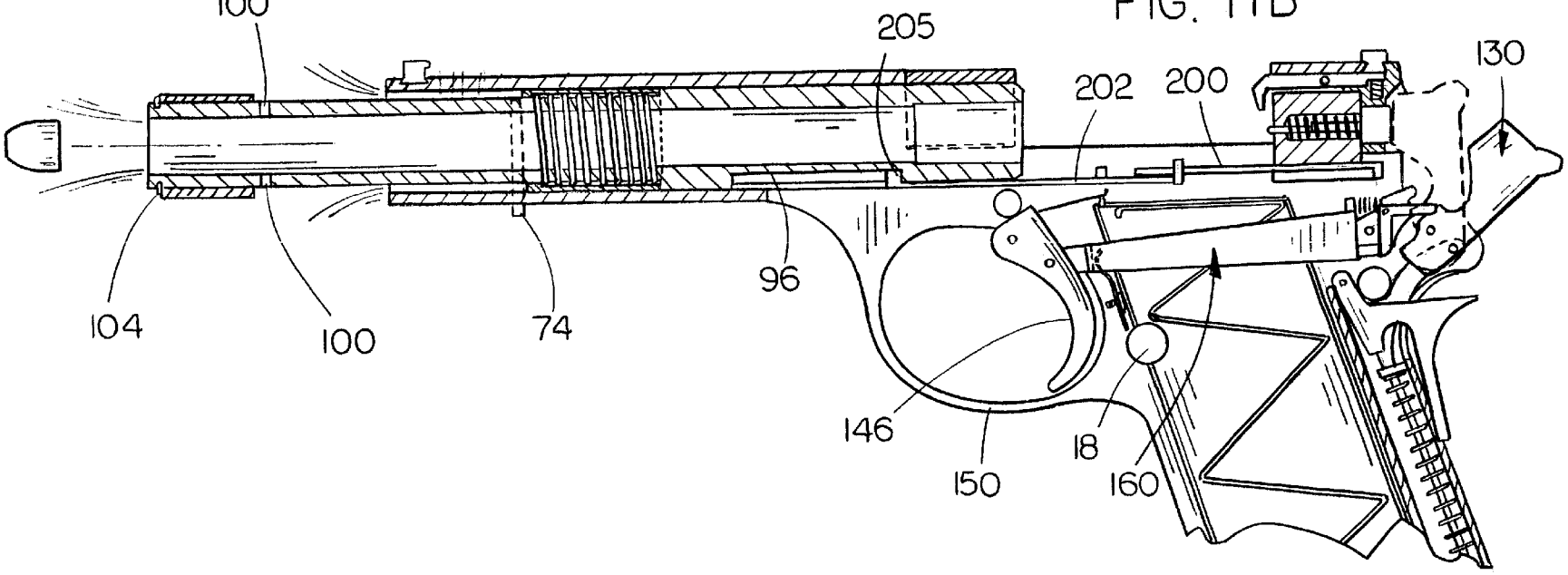

The ejection system of this invention is best illustrated in FIGS. 11A and 11B. Ejection system 198 includes an ejector spring 200 and an ejector drag link 202. The ejector drag link 202 has its forward end movably received in the groove 96, as illustrated in FIGS. 11A and 11B.

Figure 15:
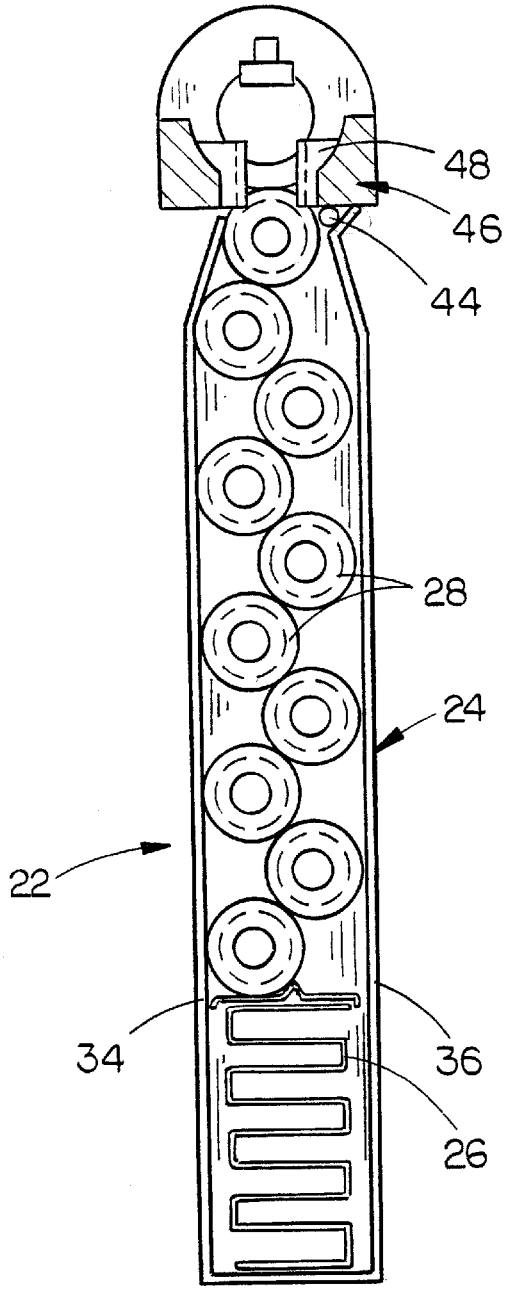
FIG. 15 is a view similar to FIG. 14 except that the magazine is in its fully inserted position to allow the uppermost cartridge to be fed into the breech of the handgun.
Figure 16A:
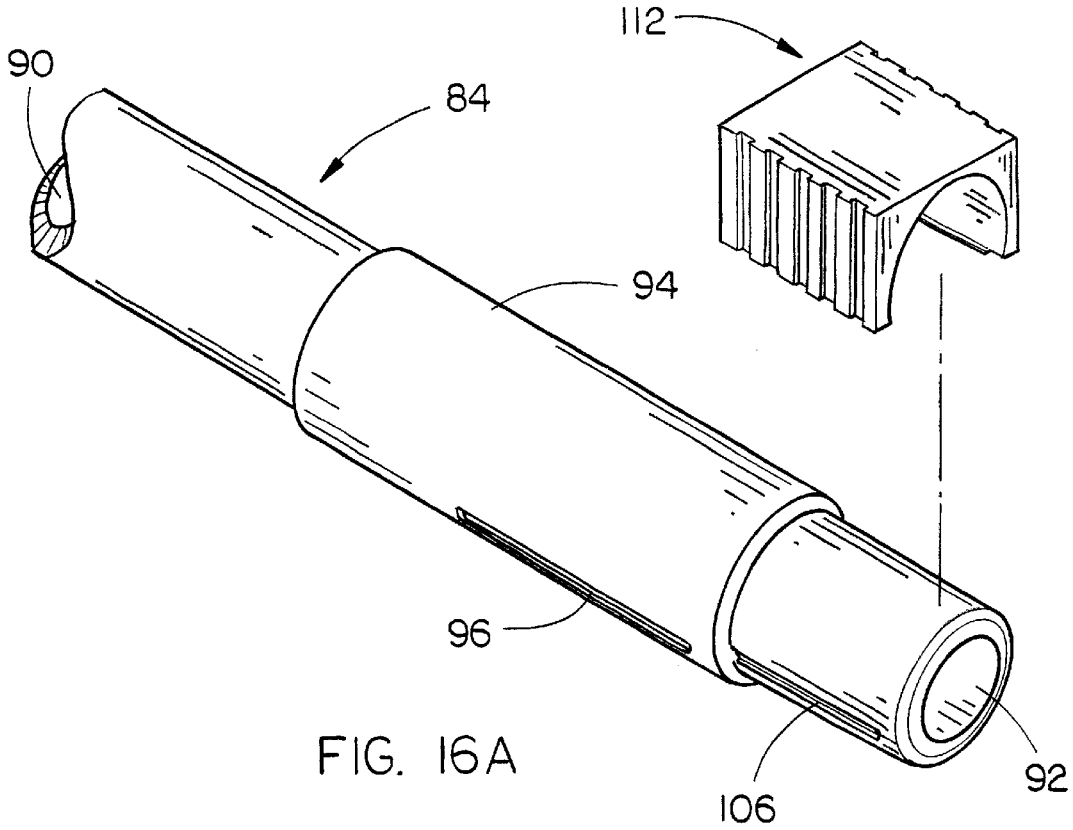
FIG. 16A is partial perspective view of the rearward end of the barrel with the grip portion being removed therefrom.
Figure 16B:
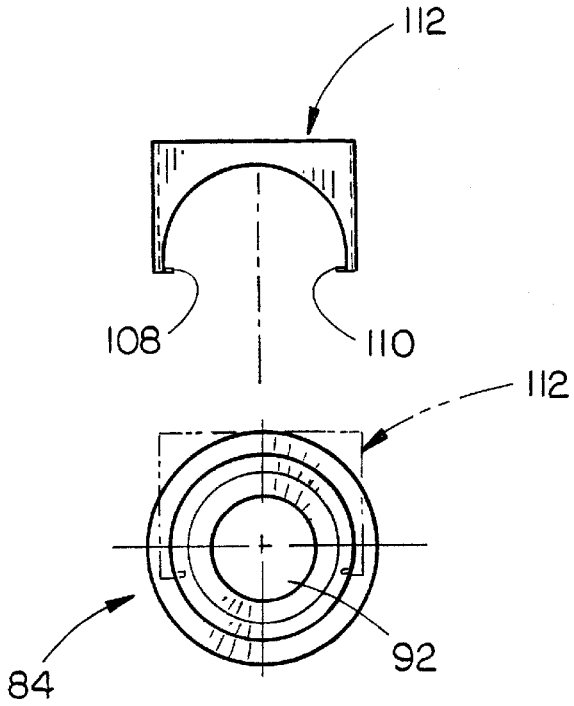
FIG. 16B is a rear view of the structure of FIG. 16A.

The operation of the handgun is as follows. The cartridge or ammunition magazine is loaded by successively inserting cartridges 28 straight down through the upper end of the magazine. As the cartridge is lowered into the magazine, the cartridge engages the loading lip 42 which deflects outwardly causing the upper end portions 38 and 40 to deflect outwardly so that the cartridge may move downwardly into the magazine compressing the magazine follower spring 26. Additional cartridges are loaded in the same manner and are stacked as shown in FIG. 15.

To load the weapon, the magazine 22 is inserted in the bottom opening of the grip of the frame and pushed upwardly until secured by the clip release 18 being received by the notch 204 which is formed in the forward end of the magazine 22 (FIG. 6). Simultaneously with the loading, the lip 42 engages the lug 44 in the frame causing the upper end portions of the magazine to separate to allow the uppermost cartridge to engage the guides 48 in the barrel housing 46.

To manually charge the chamber, the barrel 84 is grasped at the barrel grip portion 112 and pulled forward which opens the breech and compresses the barrel spring 114. As the breech is fully opened, the uppermost cartridge 28 is free to move upwardly in the guides 48 until stopped by the extractor 208 which is pivotally secured to the frame 12 at 210. The rearward end of the extractor 208 is urged upwardly by the spring 212. The forward end of the extractor 208 includes downwardly extending extractor arm 214 which is received in the groove 216 of the cartridge 28. At this time, the cartridge 28 is in direct alignment with the centerline of the bore.

Upon depression of the barrel release 218, the barrel spring 114 drives the barrel 84 rearwardly enclosing the cartridge. The succeeding cartridge is depressed downwardly into the magazine 22 by the bottom of the breech end of the barrel 84.

The hammer 130 is then manually retracted into its firing position. At this point, the handgun cannot be fired unless the barrel is fully home in the battery position due to the hammer safety assembly 190. Hammer safety 190 blocks movement of the hammer 130 until the rearward end of the barrel 84 engages the forward end of the hammer safety which rotates the safety 190 outwardly against spring tension to clear the path of the hammer 130. Another safety feature which prevents firing if the breech is even partially open is the trigger safety 152 is the fact that the trigger 146 is prevented from movement by the spring-loaded trigger block 154. As the barrel moves to the battery position, the front end of the slot 98 in the barrel 84 causes the trigger block 154 to retract against spring tension thereby clearing the hammer to rotate. A further safety feature is the grip safety 144. The grip safety 144 is spring-loaded to cause the grip safety to rotate outwardly from the frame wherein a lug on the grip safety overrides a lug on the hammer spring guide 134 to prevent upward movement and rotation of the hammer. Yet another safety feature is the safety/de-cocker 142. The safety/de-cocker 142 must be in the "off" position so that the rotating bolt 140 provides clearance for the hammer spring guide 134 to move upwardly allowing the hammer to rotate.

Figures 12A, 12B, 12C:
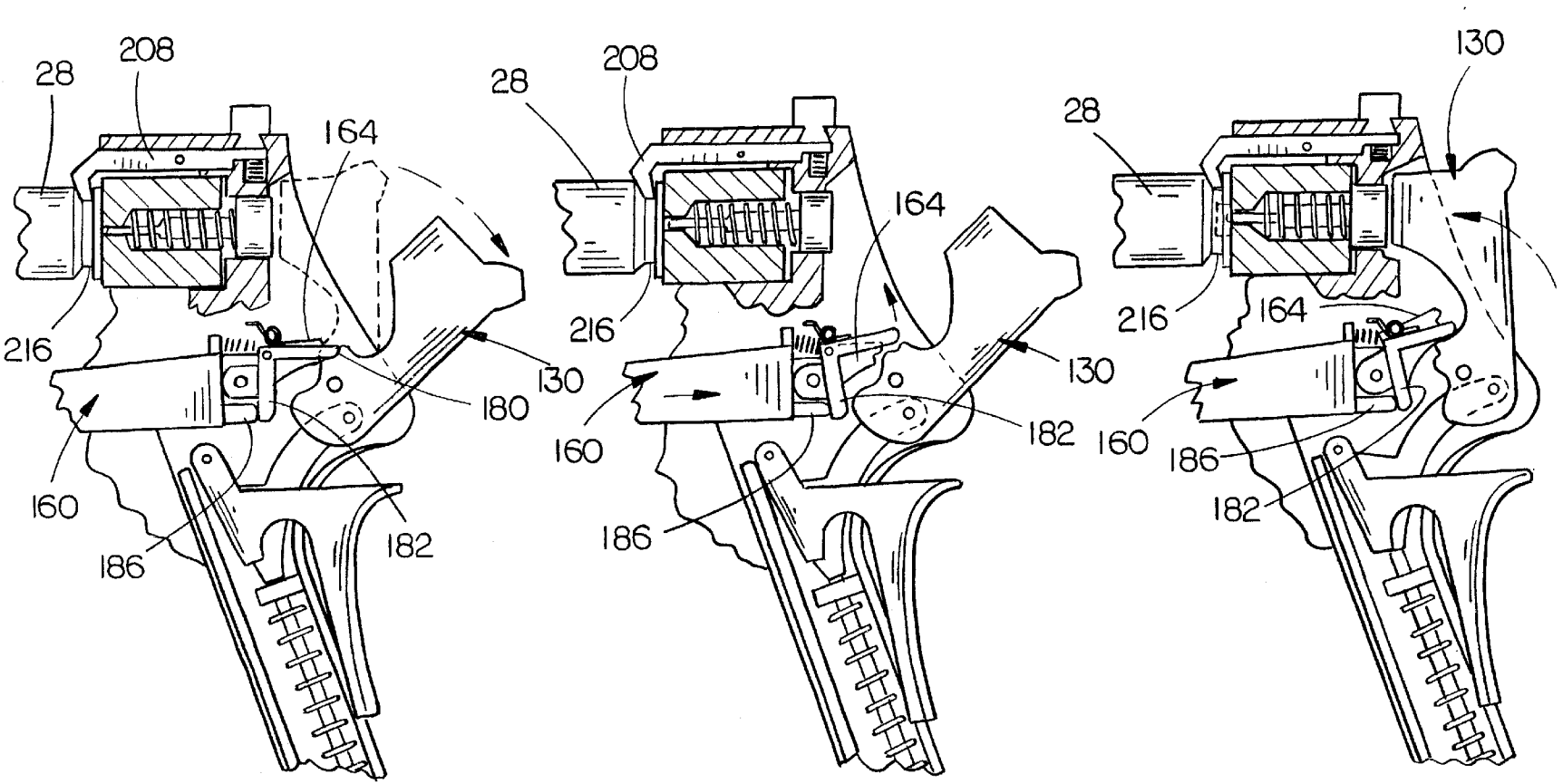
FIG. 12A is a sectional view illustrating the hammer in its fully cocked position with the sear maintaining the hammer in its fully cocked position.
FIG. 12B is a view similar to FIG. 12A except that the trigger has been moved rearwardly to disengage the sear from the hammer.
FIG. 12C illustrates the hammer being moved to its de-cocked firing position.
Figures 13A, 13B, 13C:
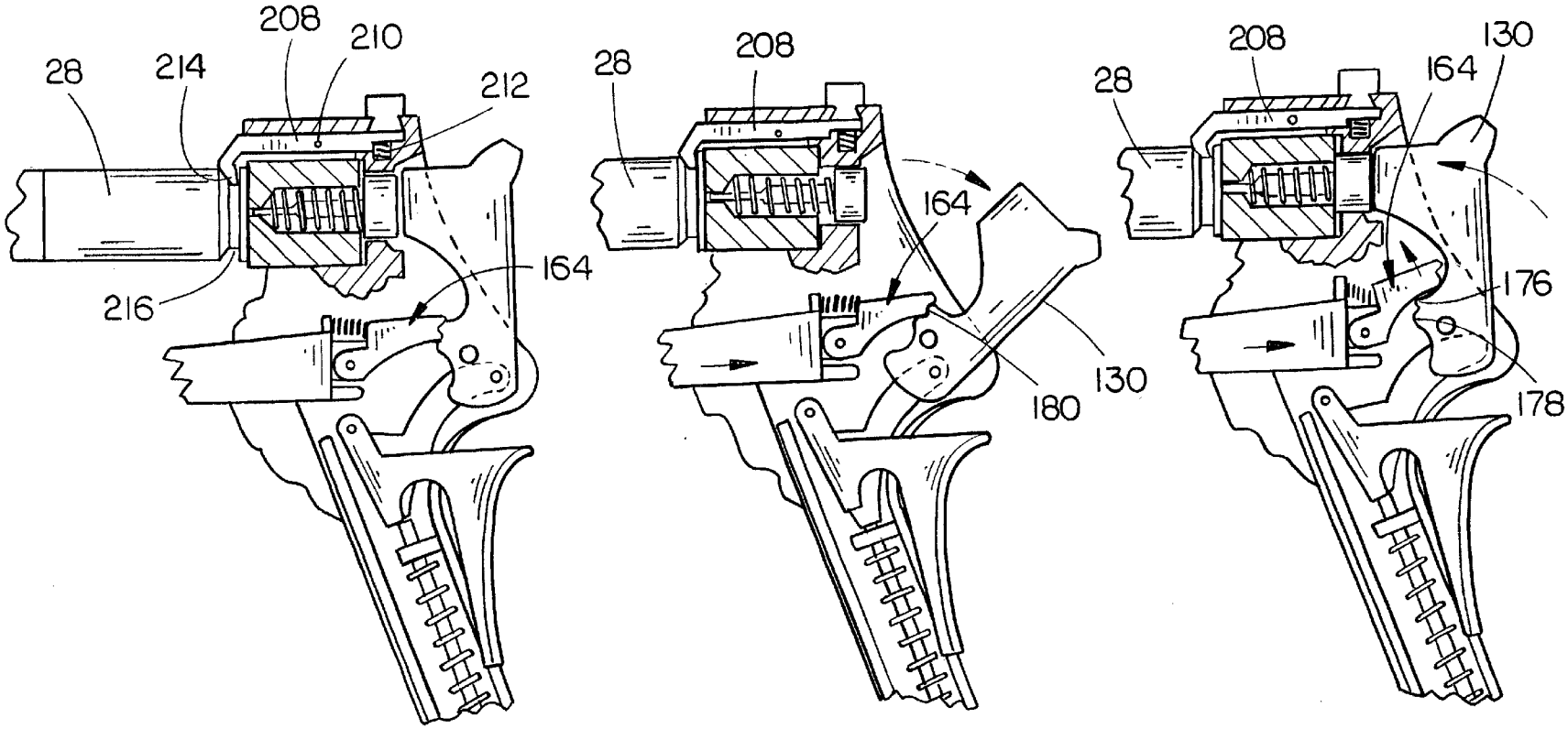
FIG. 13A illustrates the handgun in its battery position with the hammer in a de-cocked position.
FIG. 13B illustrates the trigger bow assembly being moved backwardly or rearwardly to cock the hammer.
FIG. 13C illustrates the bow assembly having been moved further rearwardly from that of FIG. 13B to permit the hammer to be driven to its firing position.

When all of the safety conditions are met, the trigger 146 may be depressed which causes it to rotate and move the bow assembly 160 rearwardly until the bearing lug 186 engages the sear 182 causing it to rotate and release the spring-loaded hammer 130. This operation is known as a single action operation and the hammer would have already been cocked prior to the trigger being depressed or moved rearwardly (FIGS. 12A and 12B).

The firing mechanism may also be operated in a double action fashion as will now be described. The trigger 146 is depressed thereby compressing the trigger spring 218 causing it to rotate and move the bow assembly 160 rearwardly until the cocking pawl 164 engages cam 176 on the hammer 130. This action causes the hammer 130 to rotate to a firing position. Consequently, the cocking pawl 164 rides up the cam 176 until it overrides the cam thereby releasing the hammer to fall until engaged by the sear 182. Further, rearward movement of the bow 160 causes the lug 186 to engage the lower end of sear 182 causing it to rotate counterclockwise releasing the hammer 130.

After the hammer has been released through a single action or a double action operation, as the hammer 130 falls due to the action of the hammer spring 138, the hammer strikes the spring-loaded firing pin 128 causing it to strike the cartridge primer and simultaneously drive the piston 124 firmly against the base of the cartridge. As the cartridge discharges, the energy drives the breech piston 124 rearwardly a fraction of an inch until stopped by shoulder 58 of the opening 56. Simultaneously, the hard contact between the breech piston 124 and the shoulder 58 causes the head of the firing pin to strike the hammer 130 causing it to rotate rearwardly and thereby re-cocking the weapon. Return movement of the hammer 130 is stopped by the spring-loaded sear 182 until subsequently released by the trigger mechanism.

As the bullet is driven through the muzzle, a portion of the gas is released through the gas ports 100 near the muzzle into the circular cavity between the fixed barrel stop 118 and the barrel sleeve 122. The gas pressure forces the barrel sleeve 122 and barrel 84 to move forwardly against the barrel return spring 114 until stopped by the rear shoulder of the barrel stop 118. The spent cartridge case is held in the open breech by the extractor 208.

As the breech is opened, the chamber end of the barrel 84 passes over the end of the ejector spring 200 which releases the spring tension to strike and eject the spent cartridge case, as seen in FIG. 11B. The ejector spring 200 is retracted by the forward movement of the drag link 202 which contains an aperture 203 through which the ejector spring 200 passes. The drag link 202 is pulled forward by engagement of a protruding lug on the forward end against a shoulder 205 on the lower portion of the barrel 84. As the ejector spring 200 is retracted and with the breech open, the succeeding round of ammunition (cartridge) is free to move upwardly from the magazine until it is stopped by the extractor 208.

Thus it can be seen that the invention accomplishes at least all of its stated objectives.

I claim:

1. A semi-automatic handgun, comprising:

a frame, having upper and lower ends, including a grip, a trigger guard, a trigger, and a cartridge magazine removably mounted in said grip;

said cartridge magazine adapted to have cartridges contained therein in a vertically stacked manner;

a barrel housing, having rearward and forward ends, on the upper end of said frame;

said barrel housing having a breech formed therein which has rearward and forward ends;

said breech being in communication with said cartridge magazine whereby cartridges may be delivered to said breech;

said barrel housing having an ejection port formed therein which communicates with said breech;

said barrel housing having a first elongated opening formed therein which extends forwardly from said forward end of said breech, to said forward end of said barrel housing;

said barrel housing having a second elongated opening formed therein which extends rearwardly from said rearward end of said breech towards said rearward end of said barrel housing;

an elongated barrel, having forward and rearward ends, movably mounted in said barrel housing between a rearward battery position in said barrel housing to a forward position in said barrel housing;

said barrel having a rifled bore extending therethrough;

a barrel spring in said barrel housing which yieldably urges said barrel to its said rearward battery position;

said barrel closing said breech when in its rearward battery position;

a spring-loaded firing pin positioned in said second elongated opening in said barrel housing;

a hammer pivotally mounted on said frame which is movable between a rearward cocked position and to a forward firing position;

said trigger being operatively connected to said hammer by means of a sear assembly;

a hammer spring in said frame connected to said hammer for driving said hammer from its rearward cocked position to its forward firing position when said trigger is operated;

said hammer striking said firing pin when said hammer is driven from its said rearward cocked position to its said forward firing position;

said rearward end of said barrel including a chamber for receiving the uppermost cartridge in said cartridge magazine when said barrel is moved from its said forward position to its said rearward position so that the cartridge will be aligned with said firing pin;

said firing pin causing the detonation of the cartridge in said barrel when said hammer strikes said firing pin;

the detonation of said cartridge causing said barrel to move from its said rearward position to its said forward position;

a piston, having rearward and forward ends, movably mounted in said second elongated bore in said barrel housing;

said piston being movable between a forward position and a rearward position;

a spring urging said piston to its said forward position;

said forward end of said piston being closely positioned adjacent the cartridge in said barrel;

said hammer being positioned rearwardly of said rearward end of said piston when said hammer is in its said forward firing position;

said firing pin extending through said piston;

the detonation of the cartridge in said barrel causing said piston to move from its forward position to its said rearward position thereby causing said firing pin to move said hammer from its said forward firing position to its said rearward cocked position.

2. The semi-automatic handgun of claim 1 wherein said barrel travels forwardly and rearwardly in a straight line.

3. The semi-automatic handgun of claim 1 wherein the rearward end of said chamber, when said barrel is in its said rearward position, is positioned near the rearward end of said cartridge magazine.

4. The semi-automatic handgun of claim 1 wherein the forward movement of the barrel on firing counteracts at least some of the rearward energy of discharge thereby reducing the recoil of the handgun.

5. The semi-automatic handgun of claim 1 wherein said barrel spring is positioned at said forward end of said barrel to yieldably resist the forward movement of the barrel.

6. The semi-automatic handgun of claim 1 wherein the cartridges in said magazine are elevated from the magazine in a horizontal attitude so as to be directly in line with the bore of said barrel.

7. The semi-automatic handgun of claim 1 wherein said magazine includes flexible closure means at the upper end thereof which yieldably maintains the cartridges therein.

8. The semi-automatic handgun of claim 7 wherein said flexible closure means permits the cartridges to be inserted into the magazine in a vertically downwardly direction.

9. The semi-automatic handgun of claim 1 wherein said barrel has a gas vent means formed therein adjacent the muzzle end thereof which communicates with a forwardly extending cavity formed in said barrel housing; said barrel having a sleeve positioned on its forward end which normally seals the forward end of said cavity; the exhaust of combustion gases through said vent means, upon firing into said cavity and against said sleeve causing said barrel to move to its said forward position.

10. A semi-automatic weapon, comprising:

a frame;

a barrel housing, having a rearward end and a forward end, mounted on said frame;

a barrel, having a rearward end and a forward end, movably mounted on said barrel housing;

said barrel having a cartridge chamber at its rearward end for receiving a cartridge therein;

said barrel being movable between a rearward position and a forward position with respect to said barrel housing;

said barrel normally being in said rearward position;

said barrel moving forwardly in a straight line from its said rearward position upon firing of the cartridge in said chamber to counteract the rearward energy of discharge thereby reducing recoil;

and a firing hammer which is re-cooked upon the cartridge being fired by a piston and firing pin assembly which is positioned between the rearward end of said barrel and said firing hammer.

11. The weapon of claim 10 wherein the forward movement of the barrel also accomplishes ejection of the spent cartridge and reloading of said chamber.

12. The weapon of claim 10 further including means for firing the cartridge in a single action manner.

13. The weapon of claim 10 wherein the forward movement of said barrel is caused by the discharge of combustion gases from the bore of said barrel.

14. The weapon of claim 13 wherein said piston and firing pin assembly include a firing pin which is movably positioned in a piston and which movably protrudes forwardly and rearwardly therefrom.

* * * * *